United States Patent [19]

Katchka et al.

[11] 3,998,582

[45] Dec. 21, 1976

[54] GASEOUS FUEL BURNER SYSTEM

[75] Inventors: Jay R. Katchka, Long Beach; Henry C. Braucksiek, Buena Park, both of Calif.

[73] Assignee: Robertshaw Controls Company, Richmond, Va.

[22] Filed: Nov. 25, 1974

[21] Appl. No.: 527,099

Related U.S. Application Data

[62] Division of Ser. No. 392,403, Aug. 28, 1973, Pat. No. 3,850,370, which is a division of Ser. No. 98,246, Dec. 15, 1970, Pat. No. 3,762,639.

[52] U.S. Cl. ..... 431/349

[51] Int. Cl.[2] ..... F23D 13/36

[58] Field of Search ..... 431/349, 63, 350; 236/15 A

[56] References Cited

UNITED STATES PATENTS

| | | | |
|---|---|---|---|
| 1,018,819 | 2/1912 | Gilbert | 431/349 |
| 1,881,637 | 10/1932 | Johnson | 236/15 A |
| 1,967,606 | 7/1934 | Brown | 431/349 |
| 2,518,050 | 8/1950 | Nelson | 431/350 X |
| 2,960,157 | 11/1960 | Dolby | 431/349 X |
| 3,002,553 | 10/1961 | Reed | 431/349 |
| 3,304,014 | 2/1967 | Hancock et al. | 431/349 |

*Primary Examiner*—William E. Wayner
*Attorney, Agent, or Firm*—Anthony A. O'Brien

[57] ABSTRACT

A gaseous fuel burner system wherein a single burner is designed to operate at dual rates in accordance with the fuel flow supplied by a combination control device which is operated thermostatically and which includes the features of a manual on-off valving mechanism and a burner flame responsive safety valving mechanism. A single conduit between the control device and the burner supplies the fuel flow at both rates of flow to the burner that provides two flame patterns with each flame pattern impinging on the flame responsive element of the safety valving mechanism.

4 Claims, 14 Drawing Figures

GASEOUS FUEL BURNER SYSTEM

CROSS REFERENCE TO RELATED APPLICATIONS

This is a division of application Ser. No. 392,403 filed Aug. 28, 1973, now U.S. Pat. No. 3,850,370, which application is a divisional application of parent application Ser. No. 98,246 filed Dec. 15, 1970, now U.S. Pat. No. 3,762,639.

BACKGROUND OF THE INVENTION

1. Field of the Invention

The present invention relates to a fuel burner system and, in particular, to such a system having burner apparatus supplied with fuel under the control of a thermostatic control device.

2. Description of the Prior Art

Conventional gaseous fuel burner systems embodying thermostatic controls are well known in the prior art as illustrated in U.S. Pats. Nos. 2,121,977; 2,509,679; 2,513,705; 3,138,194; and 3,314,604. Such prior art demonstrates that a conventional fuel burner system utilizes a plurality of burners, each having a separate feed conduit from the control device which has a thermostatic mechanism, a manual on-off mechanism and a safety shut-off mechanism.

The prior art is also cognizant of the general arrangement of operating structures combined into a unitary device; e.g. U.S. Patents Nos. 2,953,937; 3,433,409; 3,467,119; 3,489,350; and 3,513,873. Furthermore, such unitary control devices have been provided with various mechanisms for varying the rate of fuel flow to burner apparatus in accordance with variations in demand sensed by thermostatic means; illustrations of such devices are found in U.S. Pats. Nos. 3,159,346; 3,338,264; 3,369,562; 3,441,049; and 3,486,732. Each of the patents listed above in this paragraph demonstrates that a conventional unitary control device with a combination of operating structures provides at least two outlet flow ports separately supplying the burner apparatus whereby a standby flame is maintained when the thermostatic mechanism prevents fuel flow for a main flame.

U.S. Pats. Nos. 1,763,295; 2,155,339; 2,220,247; 2,474,547; 2,531,316; 2,840,152; 3,164,200; 3,405,999; and No. 3,516,773 are representative of the prior art with respect to various types of burner apparatus wherein a main flame is ignited by means of a standby or pilot flame. These prior art patents illustrate the conventional nature of plural feeds to establish plural flame patterns and the use of a flame responsive thermocouple which is responsive to only a single flame pattern.

SUMMARY OF THE INVENTION

In accordance with the present invention, the fuel burning system includes burner apparatus having main outlet port means and auxiliary outlet port means, a source of fuel flow for the burner apparatus, a thermostatically operated control device controlling the rate of fuel flow to the burner apparatus, and a single flow path from the control device to the burner apparatus whereby the flame pattern issuing from the main outlet ports and the auxiliary outlet ports is established in accordance with the rate of fuel flow from the control device.

It is an object of the present invention to provide a fuel burning system with burner apparatus having plural flame patterns dependent upon the rate of flow of the supplied fuel.

Another object of this invention is to construct a single burner having a single inlet port and a plurality of outlet ports establishing a plurality of flame patterns.

This invention has another object in that a flame responsive element is carried by burner apparatus in such a manner that the various flame patterns of the burner apparatus always impinge on the flame responsive element.

Another object of this invention is to eliminate a separate bracket for mounting a pilot and/or thermocouple on burner apparatus.

The invention has another object in that only a single tubing or conduit supplies the burner apparatus with fuel and the need for standby or pilot gas conduits is eliminated.

Still another object of this invention is to construct a thermostatic control device that has only a single outlet for feeding a flow of fuel to burner apparatus.

This invention has another object in that a fuel burning system is provided with a dual rate burner controlled by a thermostatically operated valve which varies the rate of flow to the burner apparatus.

The present invention has another object in that leakage past a thermostatically operated valve is not a critical factor since a dual rate burner is always operating at either its high or low flame pattern.

This invention has another object in that the use of a dual rate burner minimizes the effect of throttling and/or graduating valves which control the rate of flow to the burner.

Another object of the present invention is to construct a thermostatically operated control device with a single outlet port for feeding burner apparatus at a plurality of rates of fuel flow.

A further object of this invention is to combine a manual on-off valving mechanism, a thermostatically operated valving mechanism and a flame responsive safety shut-off valving mechanism into a unitary control device having a single inlet port and a single outlet port.

Other objects and advantages of the present invention will become apparent from the following description taken in conjunction with the accompanying drawings.

DESCRIPTION OF THE PREFERRED EMBODIMENTS

Figure 1:
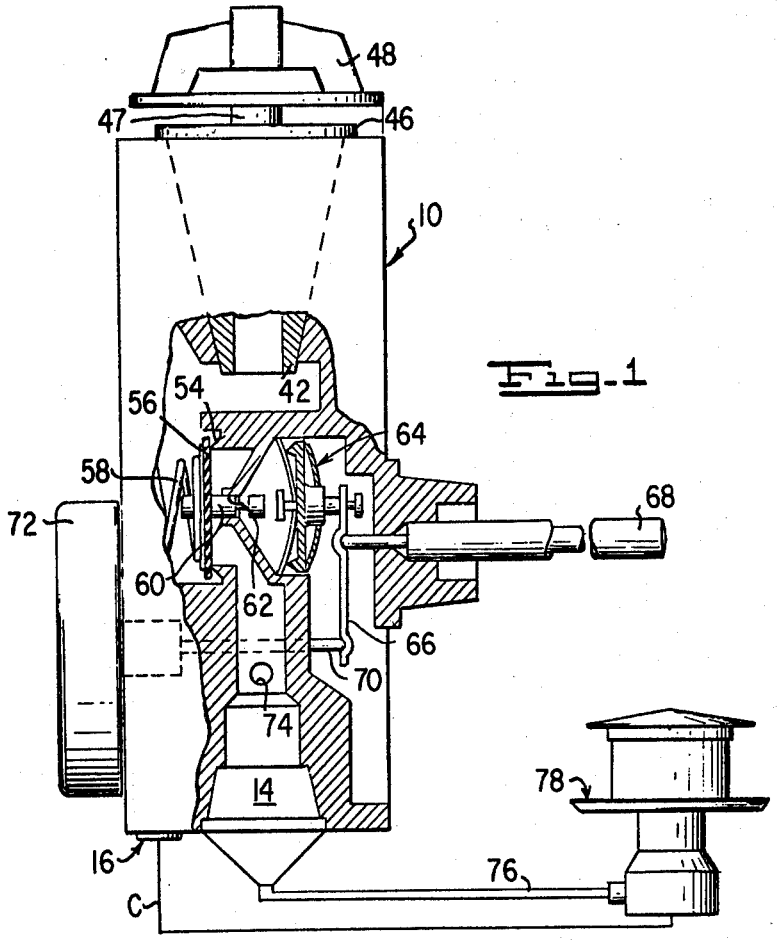
FIG. 1 is a schematic representation of a fuel burning system with parts broken away and parts in section embodying the present invention.
Figure 5:
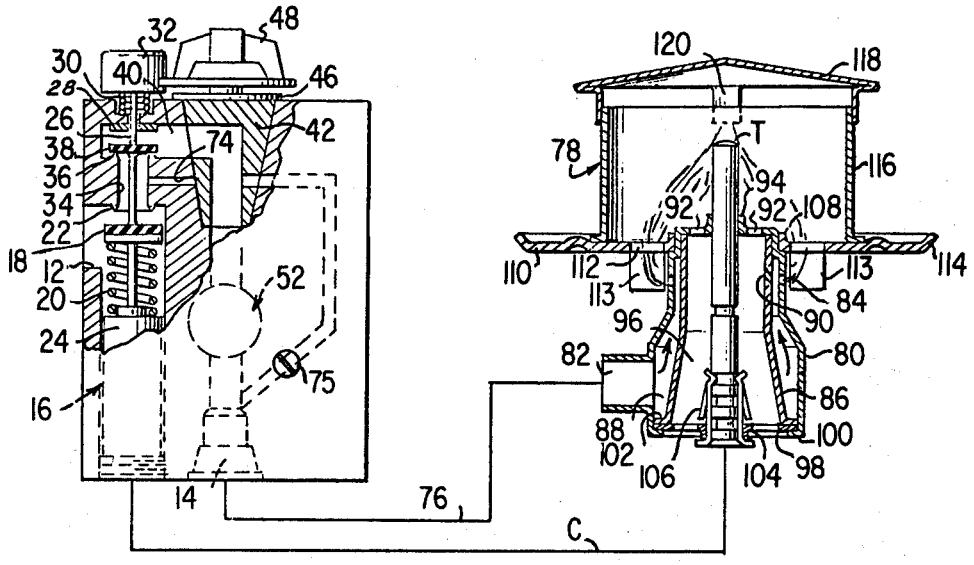
FIG. 5 is a schematic representation similar to FIG. 1 but on a different scale with parts broken away and parts in section to illustrate the manual depression of the reset button with the manual control knob being positioned as shown in FIG. 3.

As is illustrated in FIGS. 1 and 5, the present invention is embodied in a fuel burning system including fuel burner apparatus operatively connected to a control device which controls a flow of fuel to such apparatus. The control device, indicated generally at 10, has an inlet port 12 and an outlet port 14; the inlet port 12 is connected to any suitable fuel supply, such as gas. Adjacent the inlet port 12, the flow is controlled by an automatic safety mechanism, indicated generally at 16, which embodies structure that is conventionally known in the art.

The automatic safety device 16 is a flame responsive shut-off mechanism that includes a safety valve member 18 biased by a coil spring 20 towards a valve seat 22; the valve member 18 is held away from the seat 22 by an electromagnetic mechanism 24 which is electrically connected to a thermocouple T by means of a thermocouple cable C. The voltage generated by the thermocouple T is not sufficient to attract the armature to the magnet core of the electromagnetic mechanism 24 but it is sufficient to hold such armature in its attracted position. Accordingly, reset means to move the armature to its attracted position include a plunger 26 having one end extended through the valve seat 22 and its opposite end slidably extending through a wall of the casing and through a fixed sealing washer 28; a coil spring 30 surrounds the outer portion of the plunger 26 and is mounted in compression between a wall of the casing and a reset button 32 fixed to the outer end of the plunger 26. The inner end of plunger 26 projects through a passage 34, one end of which is defined by the valve seat 22 and the opposite end of which is defined by a valve seat 36. A valve member 38 fixed to an intermediate portion of the plunger 26 cooperates with the valve seat 36 to control a fuel flow to a main passage 40.

Figure 2:
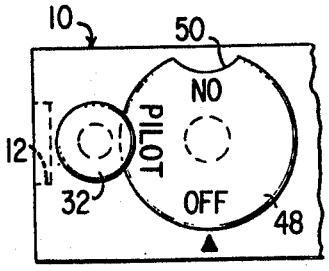
FIG. 2 is a partial top plan view of FIG. 1 showing the manual control knob in its off position.
Figure 3:
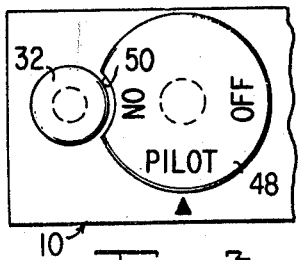
FIG. 3 is a partial top plan view similar to FIG. 2 but showing the manual control knob in its pilot position.
Figure 4:
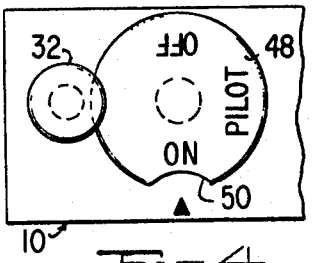
FIG. 4 is a partial top plan view similar to FIG. 3 but showing the manual control knob in its on position.

Downstream of the valving elements 36 and 38, the main flow passage is intersected by a conical bore which defines a seat for a manually rotatable plug valve 42. Plug valve 42 has a central axial bore, having inlet and outlet portions for registry with the main flow passage 40 to permit a main flow of fuel therethrough. The rotatable plug valve 42 is retained in its conical valve seat by any suitable means such as a spring retaining washer 46 secured to the top wall of the control device casing. A shaft 47 projecting from the valve plug 42 is keyed to a control knob 48 to permit manual rotation thereby. As is shown in FIGS. 2, 3 and 4, the control knob 48 is provided with indicia representing the on, pilot and off positions of the plug valve 42. A notched portion 50 in the periphery of the control knob 48 permits the reset button 32 to be depressed for ignition purposes. As is apparent from FIGS. 2 and 4, the reset button 32 cannot be depressed when the control knob 48 is in its off or on position.

Downstream of the plug valve 42, the main flow passage 40 is controlled by a thermostatically operated valve mechanism, indicated generally at 52. The mechanism 52 includes an annular valve seat 54 which intersects the main flow passage 40, and a valve disc member 56 normally biased towards the valve seat 54 by a coil spring 58 mounted in compression between the valve member 56 and an internal wall surface of the control device casing. The valve member 56 is attached to a valve stem 60 which slidably projects through a guide 62 formed in a rear wall of the control device casing; the free end of the valve stem 60 is engageable with actuating means 64. The actuating means 64 includes a conventional snap mechanism in which clicker disc moves from an operative to an inoperative position through an overcenter position with a snap action in response to an applied force exerted by a lever assembly 66. Intermediate its ends the lever assembly 66 receives the end of a rod and tube type thermostat 68. The other end of the lever 66 is engaged by an adjusting shaft 70 which is rotated to a selected position by a temperature adjusting dial 72. The above described structure of the thermostatically operated valving mechanism 52, the snap acting device 64, the lever assembly 66, the rod and tube thermostat 68, the adjusting shaft and temperature selection dial 70 and 72 are conventional structures well known in the art and for a more complete description of the structure and operation reference is made to U.S. Pat. No. 2,953,937.

Intermediate the valve seats 22 and 36, the internal passage 34 communicates with an auxiliary flow passage 74. The flow through the auxiliary passage 74 is at a smaller rate than that through the main passage and may be consistent with capacities usually associated with pilot burners. While the smaller flow passage 74 may completely bypass the manual plug valve 42, as an additional safety feature an exterior channel in the plug valve 42 may be utilized to intersect the auxiliary flow passage 74 and thus establish manual control of the auxiliary flow of fuel. Downstream of the manual plug valve 42, the auxiliary flow passage 74 is provided with an adjustable flow restrictor 75 to preset the flow rate through the auxiliary passage 74. Downstream of the adjustable flow restrictor 75, the auxiliary flow passage 74 intersects the main passageway at a position adjacent the outlet 14 and downstream of the thermostatically operated valving mechanism 52. Thus, any flow from the unitary control device 10 issues from the single outlet port 14 to a single conduit 76 extending between the outlet 14 and the burner apparatus, indicated generally at 78.

The burner apparatus 78 includes a cylindrical housing 80 having a single inlet port 82 and a plurality of circumferentially spaced outlet ports 84. A second cylindrical housing 86 is generally concentrically arranged in the outer housing 80 and the hollow space between the two housings defines a generally cylindrical annular chamber 88 receiving a flow of gas from the inlet 82 which is located on the outer housing 80 adjacent the lower end thereof as viewed in FIGS. 5 and 6. The two housings 80 and 86 have portions that are conical in cross-section constructed so that the annular chamber 88 is gradually reduced in cross-section toward its upper end.

Figure 6:
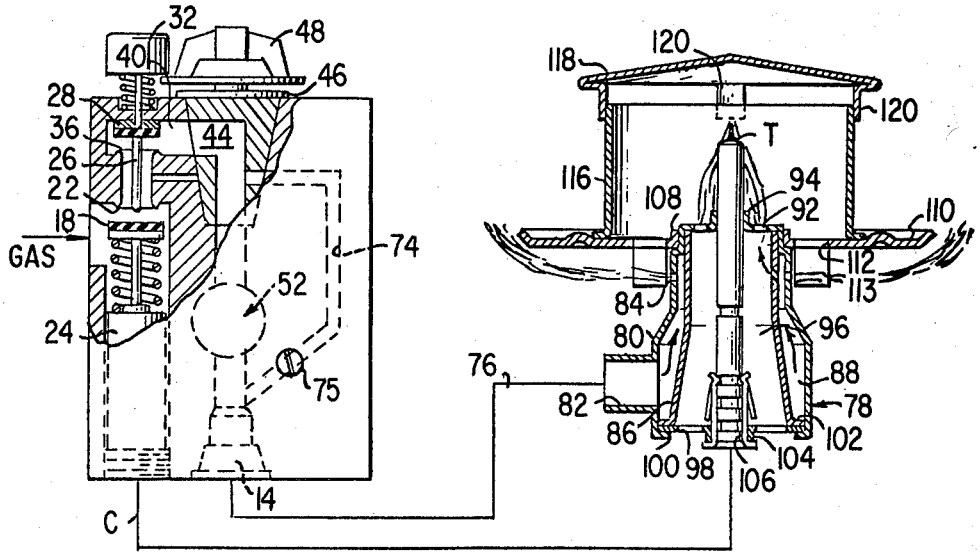
FIG. 6 is a schematic representation similar to FIG. 5 but correlated to the position of the manual control knob illustrated in FIG. 4.

As is illustrated in FIGS. 5 and 6, the inner housing 86 is provided with a single port 90 located in slightly vertical spaced relation above the outer housing ports 84 and being angled upwardly toward the upper end of the housing 86; the lower edge of the single port 90 (FIG. 5) is in general alignment with one of the ports 84 to facilitate cleaning of the port 90 as by a wire inserted through such two ports. The outer housing 80 has a top wall with a plurality of circumferentially spaced ports 92 and a centrally located annular collar 94 through which the thermocouple T is mounted. A flow of gas from the single port 90 enters a mixing chamber 96 defined by the interior of housing 86; the spaced ports 92 also communicate with the mixing chamber 96 to define burner ports therefor. An apertured plate 98 defines a common bottom wall for the two housings 80 and 86 as well as an air intake for the mixing chamber 96. Since the top of inner housing 86 abuts the top wall of outer housing 80 the two housings are assembled as unit by means of an annular flange 100 bent inwardly under the apertured plate 98 which thus engages the outwardly directed annular flange 102 on the bottom of the inner housing 86. The central portion of the apertured plate 98 has an annular collar 104 axially aligned with the top annular collar 94. Any suitable fastener such as retaining clip 106 is inserted in the collar 104 and serves as a mounting means for attaching the thermocouple T to the burner apparatus.

The top portion of outer housing 80 has an offset shoulder supporting the mounting collar 108 of a ring shaped flame spreader 110. A plurality of circumferentially spaced apertures 112 in the flame spreader 110 encircle the mounting collar 108 for a purpose to be described more fully hereinafter; as is shown in FIG. 5, the outer periphery of the flame spreader 110 terminates in an upturned flange 114. The apertures 112 are formed by spokes connecting the mounting collar 108 to the main portion of the spreader 110. The apertures 84 are located in quadrants around the outer housing 80, and the above mentioned spokes are oriented so as to be positioned above the spaced formed between the quadrants whereby a low rate or standby flame does not impinge directly on the spokes. A plurality of tabs 113 bent down from the spokes on the flame spreader 110 protect the low rate or standby flame from drafts; see FIG. 5. A hollow cylindrical shield 116 is secured by any suitable means, such as welding, to the top surface of the flame spreader; the diameter of the shield 116 is of a larger dimension than the diameter defined by the ring of apertures 112 so as not to interfere with any flame extending through the apertures 112. A cover 118 is spot welded on the top of the shield 116 by means of a plurality of tabs 120 press fitted over the outer surface of the shield 116. The spaces between the downwardly directed tabs 120 define vents whereby the interior of the shield 116 is vented to the atmosphere.

OPERATION OF FIGS. 1–6

FIGS. 1 and 2 represent the off position of the control device; i.e., in the off position of the control knob 48 (see FIG. 2), the inlet portion of the plug valve porting 44 is not in registry with the main flow passage 40 and the exterior channel of the plug valve 42 is not in registry with the auxiliary flow passage 74, so there is no flow through the control device 10. In addition, since there is no flame at the burner 78, the safety shut-off valve 18 is closed on the valve seat 22 so no flow can take effect until the ignition or reset mechanism is actuated.

To initiate operation of the control device, the control knob 48 is rotated counterclockwise from its position shown in FIG. 2 to its intermediate or pilot position as shown in FIG. 3. In such pilot position, the reset button 32 is in registry with the control knob slot 50, which permits the reset button 32 to be depressed. By depressing the reset button 32, plunger 26 and the valve 38 are moved downwardly to the positions illustrated in FIG. 5. While the button 32 is depressed, the safety shut-off valve 18 is moved away from its valve seat 22 permitting a flow of fuel from the inlet 12 to the passage 34 and thence through the auxiliary flow passage 74 to the outlet 14 through the conduit 76, burner inlet 82, burner chamber 88 and burner outlet orifices 84 where it is ignited by any suitable means, such as a match. Since the flow of fuel through auxiliary flow passage 74 is at a low rate, the flame from burner orifices 84 has a pattern that resembles an umbrella so that such flame impinges directly thermocouple T. As soon as such flame sufficiently heats the thermocouple T, the electromagnetic mechanism 24 is energized whereupon the reset button 32 may be released and the safety shut-off valve 18 will be held in its open position.

After release of the reset button 32, the control knob 48 is then rotated counterclockwise from its pilot position in FIG. 3, to its on position in FIG. 4. In such on position, the internal passage 44 of the plug valve 42 is in registry with the main flow passage 40 which permits a flow of fuel having a path traced as follows: From the inlet 12 through the valve seat 22, the passage 34, the valve seat 36, the main flow passage 40, thence through the plug valve 42 and the thermostatically operated valving mechanism 52 which is in its open condition, the outlet 14, the conduit 76, the burner inlet 82, the inlet chamber 88, the burner outlet orifices 84 whence the flame assumes a large annular shaped flame pattern adjacent the flange 114 of the flame spreader 110; at the same time, since the burner chamber 88 is supplied with the flow of fuel at a high rate, the pressure of such fuel causes fuel flow through the aperture 90 into the air-fuel mixing chamber 96 and thence through the burner orifices 92 where it forms a generally cone-shaped flame pattern impinging on the thermocouple T.

As is apparent from FIGS. 5 and 6 during the transition of the fuel flow from a low rate to a high rate, the umbrella shaped flame pattern of FIG. 5 serves to ignite the fuel from the ports 92 as well as the ports 84. Once the requirements for the demand for heat has been satisfied as sensed by the thermostat 68 (FIG. 1) the snap mechanism 64 will return to its position as illustrated in FIG. 1 whereby the thermostatically operated valving element 56 is closed on its valve seat 54. When the temperature requirements in the space being temperature controlled become unsatisfied, i.e., drop below the temperature setting selected by the temperature dial 72 the thermostatically operated valving mechanism 52 is again opened to provide a high rate of fuel flow to the burner 78.

The dual rate burner 78 will be thus cycled thermostatically between its high and low flames in accordance with the temperature demand as sensed by the thermostat 68. In the event the entire flame at the dual rate burner 78 should be extinguished for any reason, the thermocouple T will cool and the coil in the electromagnetic mechanism 24 will be deenergized causing the release of the safety shut-off valve 18 to its shut-off position.

During the thermostatic cycling of the valving mechanism 52 the dual rate burner automatically changes between its high and low flame patterns in accordance with the high and low rates of fuel flow to the burner inlet 82. It should be noted that during both high and low flow rates, the flame impinges directly on the flame responsive element T; furthermore, contrary to conventional burner apparatus, during low input conditions (FIG. 5) the fuel flow exists from the main burner outlet orifices 84. Such an arrangement eliminates the necessity of a separate pilot burner or standby burner resulting in substantial cost reduction in manufacture and assembly. Additional cost reduction is apparent from the use of the single conduit 76 which delivers fuel from the control device 10 to the burner apparatus 78 at both the high and low rates of flow; thus there is no need for a separate conduit for pilot or standby flows of fuel and no need for the accompanying fittings which are used to fasten such a separate conduit to the burner apparatus 78 and the control device 10. Even the control device 10 is more economically manufactured because it has only a single fuel flow outlet 14 while still retaining the features of a manual on-off valving mechanism, a thermostatically operated valving mechanism and a shut-off valving mechanism.

In one particular installation of the present invention, it was found that the output of the burner apparatus 78 is approximately 45,000 BTU/HR during its high input rate and approximately 1,000 BTU/HR during its low input rate. Of course, the burner apparatus may be design in accordance with the particular requirements of different types of installations. During the low rate flow to the burner apparatus 78, the fuel is under relatively low pressure and will flow out the plurality of the burner outlet ports 84 and burn around the thermocouple T. The flame pattern during the low flow rate is illustrated in FIG. 5 and the air intake openings into the chamber 96 permits a drawing in of air and out of the apertures 92 for good combustion characteristics. When the thermostatically operated valving mechanism 52 is opened, the outlet pressure in the burner head is sufficient to force the fuel outward through the same burner ports 84 and along the underside of the flame spreader 110. Since the velocity of this fuel stream is too high to allow any gas to trickle upward from the burner outlet ports 84 and heat the thermocouple, the small aperture 90 in the wall of the inner housing 86 allows a small amount of fuel to flow upward along the side of the thermocouple T and burn upon exiting the apertures 92 to heat the thermocouple.

When the burner is in the standby condition, the pressure in the outlet manifold and burner head is very low (normally less than 0.1 inch w.c. above atmospheric pressure). At this low pressure the amount of gas exiting the small port 90 is insignificant compared to the amount exiting the larger and more numerous ports 84. This very small quantity of gas exiting at port 90 in the standby condition will be burned off in the standby flame. When the burner is at the high rate condition, the higher pressure causes a significant increase in the quantity of gas exiting port 90 so that it is now sufficient to heat the thermocouple to hold the electromagnetic safety valve open without the aid of the flame from ports 84.

To manually turn off the burner apparatus, the control knob 48 is rotated clockwise from its position shown in FIG. 4 to its position shown in FIG. 2 whereby the manual plug valve 42 will cut off all fuel flow to the outlet 14. As soon as the thermocouple T cools since it is not being subject to any flame, the electromagnetic device 24 will be deenergized and the safety shut-off valve 18 will close on its valve seat 22 to provide 100% shut-off of any fuel flow from the inlet 12.

Figure 7:
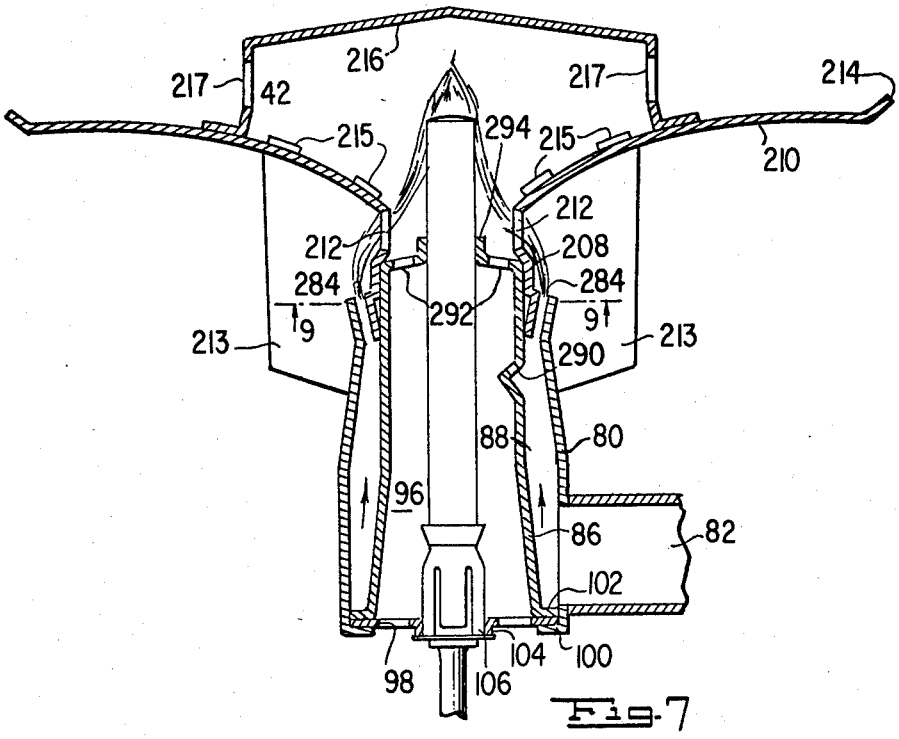
FIG. 7 is a cross section of a modification of the burner apparatus of FIG. 1 and showing the burner apparatus operating under a low rate flame condition.
Figure 8:
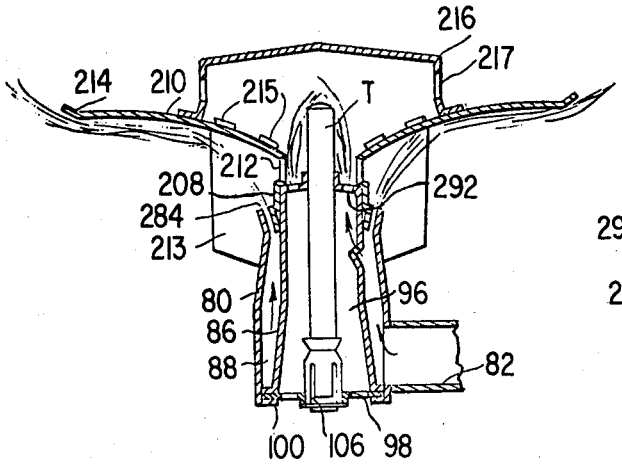
FIG. 8 is a cross section similar to FIG. 7 but on a smaller scale and showing the burner apparatus operating under a high rate flame condition.
Figure 9:
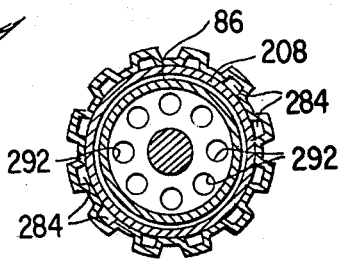
FIG. 9 is a cross section through the burner ports taken along line 9-9 of FIG. 7.

FIGS. 7–9 illustrate a second modification of the burner apparatus and only the structure which differs from that of FIGS. 5 and 6 is being described in detail. Accordingly, the same reference numerals are being utilized for those elements previously described in connection with FIGS. 1–6 and new reference numerals are being utilized for new elements.

As is shown in FIGS. 7 and 9, the outer cylindrical housing 80 has a plurality of circumferentially spaced outlet ports 284, each of which is set at an angle of approximately 30° from the vertical. Intermediate its ends, the inner housing 86 has an inwardly directed indentation formed by right angled wall portions with a single port 290 in the uppermost wall portion. The indented wall portions are shown in FIG. 7 as having an L-shaped cross-section but any other suitable cross-sectional configuration, such as conical, may be used; whatever cross-section is used, the port 290 is located in the uppermost part of the indentation so as to be angled upwardly and inwardly (about 30° from the vertical) to direct the fuel flow from the port 290 toward the outlet end of the mixing chamber 96. The inner housing 86 has a top wall with plurality of circumferentially spaced ports 292 encircling an annular collar 294 through which the thermocouple T is received. A flow of gases from the single port 290 enters the mixing chamber 96 defined by the interior of the housing 86; the spaced ports 292 define burner ports at the outlet end of the mixing chamber 96.

An annular collar 208 of a ring-shaped flame spreader 210 is secured to the housing 86 adjacent its upper end by being spot welded thereto. The mounting collar 208 is offset adjacent its lower end which cooperates with the upper end of the outer housing 80 to define wall portions of the outlet ports 284. The mounting collar 208 has an annular portion disposed above the burner ports 292, which portion is provided with a plurality of circumferentially spaced apertures 212; as is apparent from FIG. 7, the low rate flame pattern emanating from the burner ports 284 projects through the spaced apertures 212 to encircle the end of the thermocouple. Above the apertures 212, the flame spreader 210 has a flange dome-shaped configuration with its outer periphery terminating in an upturned flange 214.

A plurality of draft protection tabs 213 are carried by the flame spreader 210 by means of lugs 215 which project through suitable slots in the flame spreader and which are spot welded to the top surface of the flame spreader. A condensation shield 216 in the form of an invented cup-shaped member is attached to the top surface of the flame spreader as by spot welding the flange rim of the cup to the top surface of the flame spreader 210. The condensation shield 216 defines a cover for the central portion of the flame spreader 210 and a plurality of vent openings 217 permits the interior of the shield 216 to be vented to the atmosphere.

The flame pattern shown in FIG. 7 represents a low rate flame condition with the gas exiting from the burner outlet orifices 284. The flame passes through the apertures 212 in the flame spreader and coalesces around the thermocouple in the normal manner. FIG. 8 represents the flame pattern when the burner apparatus is being supplied with the gas flow at a high rate. The high rate flame from the burner outlet orifices 284 spreads outwardly against the underside of the flame spreader 210. At the same time the pressure of the gas causes flow through the aperture 290 into the mixing chamber 96 and thence through the burner orifices 292 where it forms a generally cone-shaped flame pattern impinging on the thermocouple. The other parts of the sequence of operation of the burner apparatus shown in FIGS. 7–9 are substantially the same as those described above in connection with the sequence of operation of FIGS. 1–7. and are not being repeated for the sake of brevity.

A third modification of the burner apparatus is illustrated in FIGS. 10–14 wherein only that structure and operation which differs from that of FIGS. 1–9, is being described below.

Figure 10:
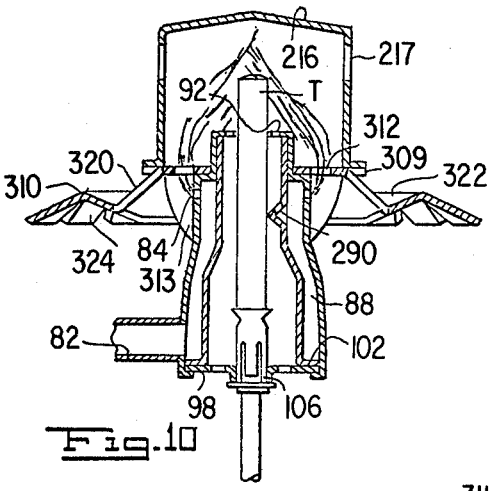
FIG. 10 is a cross section of another modification of the burner apparatus of FIG. 1 and showing such apparatus operating under a low rate flame condition.
Figure 11:
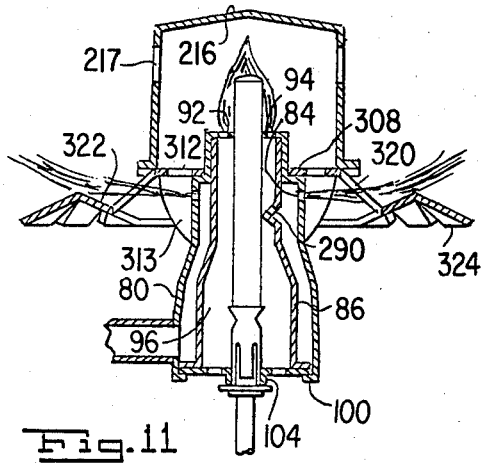
FIG. 11 is a cross section similar to FIG. 10 but showing the burner apparatus operating under a high rate flame condition.

As is shown in FIGS. 10 and 11, the indentation for the single port 290 in the housing 86 is disposed adjacent the thermocouple T; the burner port 290 in such indentation directs the gas flow upwardly toward the outlet of the mixing chamber 96.

Figure 12:
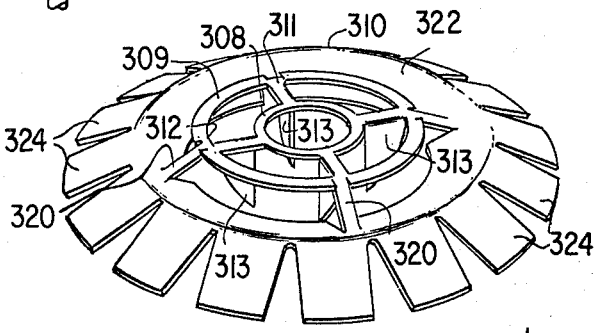
FIG. 12 is an isometric view of a detail of FIG. 10.
Figure 13:
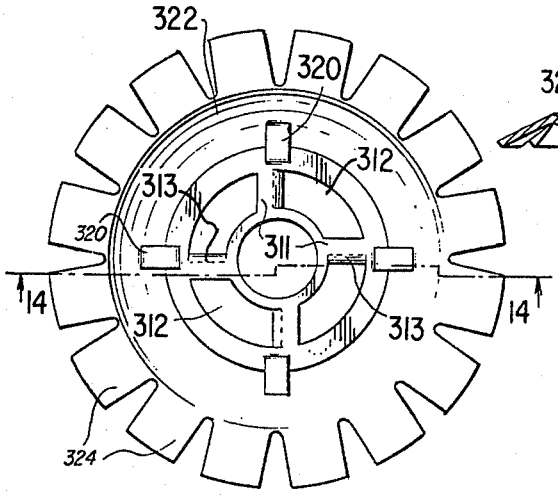
FIG. 13 is a top plan view of FIG. 12.
Figure 14:
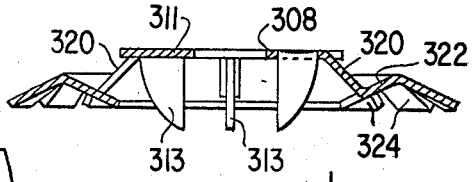
FIG. 14 is a cross section taken along line 14—14 of FIG. 13.

A mounting collar 308 centrally located on a flame spreader 310 is attached to an offset shoulder adjacent the top portion of the outer housing 80 and is secured thereto as by being spot welded. A plurality of openings or apertures 312 are formed in the flame spreader by spokes 311 (see FIG. 13) connecting the mounting collar 308 to an outer ring member 309. A tab 313 is bent down from each spoke 311 to protect the low rate or standby flame from drafts. A plurality (e.g., four) of spaced struts 320 project downwardly and outwardly from the ring element 309 to support an integrally formed annulus 322 which is disposed in an inclined plane in such a manner as to present an annular surface on the top side of the flame spreader 310; as is illustrated in FIGS. 12 and 13, the annular surface is angularly disposed upwardly from a horizontal plane defined by the lowermost edges of the flame spreader assembly. A plurality of fins 324 are bent downwardly from the outer periphery of the annular surface 322 and are utilized to dissipate heat from the flame spreader.

In the operation of the burner apparatus shown in FIGS. 10–14, the gas exiting from the burner outlet orifices 84 during a high input rate causes a flame pattern as shown in FIG. 11 which impinges on the annular surface 322 while the gas exiting from the burner ports 92 impinge on the thermocouple. During a low input rate, the gas exiting from the burner outlet orifices 84 cause a flame pattern as shown in FIG. 10 wherein the low rate flame projects through the apertures 312 to impinge on the thermocouple. Thus, FIGS. 10–14 illustrate burner apparatus where the high rate flame impinges on the top surface of the flame spreader whereas in the previous modifications the high rate flame impinged on the under surface of the flame spreader. The particular design of the flame spreader shown in FIGS. 10–14 permits better control of the high rate flame characteristics and size due to the ability to control the angle of impingement of the gas hitting the angled surface 322.

In accordance with the present invention, the unitary multiple rate burner exhibits desired performance characteristics at two levels of operation, main flame and standby flame. The significance of such performance becomes apparent when comparing the increase of the input rate of gas from the low rate maintaining the standby flame to the high rate maintaining the main flame. For example, pilot burners are conventionally identified according to their input rate, i.e., BTU per hour at a particular pressure generally measured in inches of a water column; the usual type of pilot burner would have an input rate of 750 to 1000 BTU per hour and such a pilot burner could be operated between two flame levels such as is shown in U.S. Pat. No. 3,405,999. However, in known prior art devices, the increase in the BTU input rate is usually limited to a multiplier of approximately three. Since the BTU input rate varies in proportion to the square root of the gas pressure (measured in inches of a water column), an increase of such rate in a conventional pilot burner would result in a higher gas pressure that creates other problems such as blowing most of the pilot flame away from the thermocouple. Thus, a conventional pilot burner could not be increased to operate at a BTU input rate necessary to sustain a main flame.

The present invention has the particular advantage of a single burner capable of operating at a standby flame level as well as at a main flame level. In order to avoid the peculiar problems associated with increasing the BTU input rate, it has been discovered that the BTU input rate must be limited to a multiplier of at least five; i.e., the gas rate must be increased from its minimum flow associated with a standby flame having a 1000 BTU per hour input rate to a higher flow associated with a main flame having a 5000 BTU per hour input rate. It is this minimum multiplier of five which defines the minimum range of operation necessary to sustain both the standby flame and the main flame.

Inasmuch as the present invention is subject to many variations, modifications and changes in detail, it is intended that all matter contained in the foregoing description or shown in the accompanying drawing shall be interpreted as illustrative and not in a limiting sense.

What is claimed is:

1. A dual rate burner comprising a burner housing having first and second outlet orifice means, wall means in said housing separating the same into first and second chamber, said first outlet orifice means leading from said first chamber and said second outlet orifice means leading from said second chamber, aperture means in said wall means establishing communication between said first and second chamber, said aperture means defining a cross-sectional flow area substantially smaller than a cross-sectional flow area defined by said first outlet orifice means whereby a low fuel pressure in said first chamber causes a fuel flow through said first outlet orifice means and whereby a high fuel pressure in said first chamber causes a fuel flow through said outlet orifice means and through said aperture means and said second outlet orifice means, a single inlet for said burner housing communicating with said first chamber for supplying the same with fuel at dual flow rates, a wall extending generally transverse to said wall means and defining an end wall for said second chamber, said second outlet orifice means being located in said end wall, and said second chamber having air intake means in an end portion opposite to said end wall to define an air-fuel mixing chamber upstream of said second outlet orifice means.

2. The invention as recited in claim 1 wherein said first outlet orifice means comprises a plurality of burner orifices spaced about the periphery of said burner housing, wherein said burner housing includes flame spreading means disposed above said burner orifices whereby a flame issuing from said burner orifices is shaped into a ring-like configuration during a high rate of fuel flow, and wherein said end wall and said flame spreading means having concentric openings adapted to receive a single thermocouple element.

3. The invention as recited in claim 2 wherein said flame spreading means includes a plurality of spaced openings whereby a flame issuing from said burner orifices during a low rate of fuel flow extends through said openings.

4. The invention as recited in claim 3 wherein said flame spreading means includes a plate element having a central mounting collar attached to said housing and wherein a condensation shield is mounted on said plate element.

* * * * *